US005209187A

United States Patent [19]

Khinkis

[11] Patent Number: 5,209,187

[45] Date of Patent: May 11, 1993

[54] LOW POLLUTANT - EMISSION, HIGH EFFICIENCY CYCLONIC BURNER FOR FIRETUBE BOILERS AND HEATERS

[75] Inventor: Mark J. Khinkis, Morton Grove, Ill.

[73] Assignee: Institute of Gas Technology, Chicago, Ill.

[21] Appl. No.: 739,209

[22] Filed: Aug. 1, 1991

[51] Int. Cl.[5] ..... F22B 07/00

[52] U.S. Cl. ..... 122/136 R; 122/136 C; 431/9; 431/173

[58] Field of Search ..... 122/136 R, 136 C, 160; 431/9, 173

[56] References Cited

U.S. PATENT DOCUMENTS

| | | | |
|---|---|---|---|
| 2,097,255 | 10/1937 | Saha | 431/9 |
| 3,030,773 | 4/1962 | Johnson | 431/9 |
| 3,389,692 | 6/1968 | Johnson et al. | 122/136 R |
| 3,741,166 | 6/1973 | Bailey | 431/116 |
| 3,837,788 | 9/1974 | Craig et al. | 431/10 |
| 3,859,786 | 1/1975 | Azelborn et al. | 431/173 |
| 3,934,555 | 1/1976 | Baumgartner et al. | 431/173 |
| 3,969,482 | 7/1976 | Teller | 423/235 |
| 4,007,001 | 2/1977 | Schirmer et al. | 431/10 |
| 4,021,188 | 5/1977 | Yamagishi et al. | 431/10 |
| 4,297,093 | 10/1981 | Morimoto et al. | 431/10 |
| 4,395,223 | 7/1983 | Okigami et al. | 431/10 |
| 4,575,332 | 3/1986 | Oppenberg et al. | 431/9 |
| 4,714,032 | 12/1987 | Dickinson | 431/4 |
| 4,920,925 | 5/1990 | Korenberg et al. | 122/136 R |
| 4,989,549 | 2/1991 | Korenberg | 122/136 R |

*Primary Examiner*—A. Michael Chambers
*Attorney, Agent, or Firm*—Speckman & Pauley

[57] ABSTRACT

A low pollutant emission, high efficiency cyclonic burner and cyclonic combustion process for firetube boilers and heaters in which the combustion air required for complete combustion is introduced into the cyclonic burner in stages. Fuel and primary combustion air in an amount of about 30% to about 90% of the stoichiometric requirement for complete combustion of the fuel are tangentially injected into a primary combustion zone of a combustion chamber within the burner. Secondary combustion air in an amount of about 10% to about 90% of the stoichiometric requirement for complete combustion of the fuel is introduced into a secondary combustion zone in the combustion chamber downstream of the primary combustion zone. The combustion chamber walls are cooled to maintain the combustion chamber temperature between about 1600° F. and 2400° F.

23 Claims, 9 Drawing Sheets

LOW POLLUTANT - EMISSION, HIGH EFFICIENCY CYCLONIC BURNER FOR FIRETUBE BOILERS AND HEATERS

BACKGROUND OF THE INVENTION

1. Field of the Invention

This invention relates to a process and apparatus for cyclonic combustion of fossil fuels, especially natural as, in a combustion chamber with cooled walls, which provides low pollutant-emissions as well as high system efficiencies in firetube boilers. The combustion chamber is enveloped by a cooling fluid conduit and cooled by a cooling fluid circulating through the conduit.

2. Description of the Prior Art

Conventional combustion of fossil fuels in air produces elevated temperatures which promote complex chemical reactions between oxygen and nitrogen in the air, forming various oxides of nitrogen as by-products of the combustion process. These oxides, containing nitrogen in different oxidation states, generally are grouped together under the single designation of $NO_x$. Concern over the role of $NO_x$ and other combustion by-products, such as sulfur dioxide and carbon monoxide, in "acid rain" and other environmental problems is generating considerable interest in reducing the formation of these environmentally harmful by-products of combustion.

U.S. Pat. No. 3,934,555 discloses a cast iron modular boiler having a cylindrical combustion chamber into which a mixture of gaseous fuel and air is introduced parallel to its longitudinal axis in a manner which imparts a rotational flow around the longitudinal axis. The combustion gases are recirculated internally, thereby causing dilution of gases in the boiler. The combustion chamber is encircled by a water circulation conduit and cooled by a stream of cold water that circulates through the conduit. Heat is removed from the combustion chamber as hot water.

U.S. Pat. No. 4,714,032 teaches combustion of solid fuels charged as aqueous slurries with recirculation of condensate containing particles of ash, alkali, and spent alkali by charging such condensate to an elongated entrained phase combustion reactor. Hot, dry compressed air is injected as primary and/or secondary air into the reactor. A portion of heat liberated in the combustion zone is used to vaporize the fuel slurry water. The remainder of heat which must be absorbed to reduce the combustion temperature is extracted through a heat transfer surface in the combustion zone or absorbed by latent heat of recycled water or slurry, or by a combination of both methods.

U.S. Pat. No. 3,969,482 discloses a process for treating effluent gases containing high concentrations of sulfur oxides, nitrogen oxides, hydrogen halides, silicon tetrafluoride, and mixtures thereof. Effluent gases are treated to remove a portion of acidic gases by spraying an aqueous solution or slurry into the effluent gases.

U.S. Pat. No. 4,007,001 teaches combustion producing low $NO_x$ by tangentially introducing to a first combustion zone of 0 to 65 percent of the total air and about 5 to 25 percent of the total air to a secondary combustion zone wherein there is an orifice between the primary and secondary combustion zones. U.S. Pat. No. 3,859,786 teaches a vortex flow combustor having a restricted exit from the combustion chamber.

U.S. Pat. No. 4,021,188 and U.S. Pat. No. 3,837,788 both teach staged combustion with less than the stoichiometric amount of air in the primary combustion chamber with additional air being added to the secondary combustion chamber for completion of combustion. U.S. Pat. No. 4,575,332 teaches staged combustion in a swirl combustor with forced annular recycle of flue gas to the upstream end of the primary combustion zone.

U.S. Pat. No. 4,395,223 discloses staged combustion with excess air introduced into the primary combustion zone with additional fuel being introduced into the secondary combustion zone. U.S. Pat. No. 3,741,166 discloses a blue flame burner with recycle of combustion products with low excess air to produce low $NO_x$ while U.S. Pat. No. 4,297,093 discloses a single combustion chamber with a specific flow pattern of fuel and combustion air forming fuel-rich primary zones and fuel-lean secondary zones in the combustion chamber.

SUMMARY OF THE INVENTION

It is one object of this invention to provide a process for cyclonic combustion which produces low pollutant emissions at a high system efficiency in firetube boilers.

It is another object of this invention to provide a process for cyclonic combustion wherein the combustion chamber walls are cooled by a cooling fluid.

It is another object of this invention to provide a process for cyclonic combustion in which the fuel input can be fully modulated between a turndown input and a full capacity input.

It is another object of this invention to provide a process for cyclonic combustion wherein combustion products from a primary combustion zone, including products of both incomplete and complete combustion, are recirculated within an upstream end of a secondary combustion zone into which the combustion products have been introduced.

It is yet another object of this invention to provide a process for cyclonic combustion wherein secondary combustion air is introduced into a secondary combustion zone in the combustion chamber downstream of the primary combustion zone through an annular plenum disposed within the combustion chamber and having a helical wall and/or guide vanes which impart cyclonic flow to the secondary combustion air as it enters the secondary combustion zone.

It is still another object of this invention to provide an apparatus which accommodates the process for cyclonic combustion, as herein described.

The above objects of this invention are achieved by a process for cyclonic combustion in a combustion chamber with fluid-cooled walls for use in firetube boilers having low pollutant emissions and high system efficiency, beginning with the step of tangentially injecting fuel into a primary combustion zone of a cyclonic combustion chamber. Primary combustion air also is injected tangentially into the primary combustion zone, preferably in an amount equal to between about 30% and about 90% of a stoichiometric requirement for combustion of the fuel, forming a reducing atmosphere within the primary combustion zone. For purposes of this disclosure, the primary combustion zone as used in the specification and claims is a reducing zone. A fuel-rich primary combustion air/fuel mixture is formed by the fuel and the primary combustion air. The fuel-rich primary combustion air/fuel mixture is burned within the primary combustion zone, forming primarily products of incomplete combustion.

In a preferred embodiment of this invention, fuel, preferably natural gas, is mixed with primary combustion air outside the cyclonic combustion chamber and the resulting fuel-rich primary combustion air/fuel mixture is injected tangentially into the primary combustion zone of the cyclonic combustion chamber. The combustion products from the primary combustion zone, comprising products of incomplete and complete combustion, are discharged from the primary combustion zone into a secondary combustion zone.

In another preferred embodiment of this invention, the primary combustion zone is disposed within a primary combustion chamber within the cyclonic combustion chamber and the secondary combustion zone is disposed within a secondary combustion chamber within the cyclonic combustion chamber. The primary and secondary combustion chambers are separated by a primary combustion zone discharge orifice through which the combustion products pas from the primary combustion zone into the secondary combustion zone.

Secondary air is injected tangentially into a secondary combustion zone within the cyclonic combustion chamber, preferably in an amount equal to between about 10% and about 90% of the stoichiometric requirement for combustion of the fuel, forming an oxidizing atmosphere within the secondary combustion zone. For purposes of this disclosure, the secondary combustion zone as used in the specification and claims is an oxidizing zone. The secondary combustion air is mixed with combustion products from the primary combustion zone which comprise products of incomplete and complete combustion. Combustion of the combustion products from the primary combustion zone is completed within the secondary combustion zone. Exhaust gases from the secondary combustion zone are discharged, preferably through a secondary combustion zone discharge orifice positioned at a discharge end of the cyclonic combustion chamber, downstream from the point of tangential injection of secondary combustion air.

In a preferred embodiment of this invention, the secondary combustion air is introduced into an annular-shaped plenum disposed within the cyclonic combustion chamber in the area of a transition between the primary combustion zone and the secondary combustion zone. The plenum is formed by a plenum chamber wall positioned inside the cyclonic combustion chamber and parallel to the combustion chamber side walls. The end of the annular-shaped plenum disposed toward the primary combustion zone is sealed so that secondary combustion air introduced into the plenum cannot flow back into the primary combustion zone. Within the annular-shaped plenum, disposed away from the primary combustion zone, are swirl means for swirling the secondary combustion air through which the secondary combustion air introduced into the plenum flows into the secondary combustion zone. The swirl means impart a cyclonic flow, or swirl, to the secondary combustion air as it enters the secondary combustion zone.

In accordance with one embodiment of this invention, swirl means for swirling the secondary combustion air comprises a helical channel formed by a helical wall within the plenum.

In accordance with another embodiment of this invention, swirl means for swirling the secondary combustion air comprises guide vanes disposed near the discharge end of the plenum.

In accordance with yet another embodiment of this invention, swirl means for swirling the secondary combustion air comprises a helical channel formed by a helical wall within the plenum and guide vanes disposed near the discharge end of the plenum.

In a preferred embodiment of this invention, the secondary combustion zone is disposed within a secondary combustion chamber within the cyclonic combustion chamber and the exhaust gases from the secondary combustion zone are discharged through a secondary combustion zone discharge orifice disposed at the discharge end of the secondary combustion chamber.

In a preferred embodiment of this invention, at least a portion of the cyclonic combustion chamber walls which define the primary combustion zone and the secondary combustion zone is cooled by a cooling fluid, preferably water, circulating through conduit which envelopes portions of the cyclonic combustion chamber.

In another preferred embodiment of this invention, the portion of the cyclonic combustion chamber side walls enclosing the secondary combustion zone is formed by the walls of the firetube of a firetube boiler. Water circulating within the boiler is used to remove heat from the secondary combustion zone.

In a preferred embodiment of this invention, the cyclonic combustion chamber walls are cooled with water from the boiler. A water-steam mixture is formed within water-cooling conduit enveloping at least a portion of the cyclonic combustion chamber and is discharged therefrom and returned to the boiler.

The apparatus of the water-cooled cyclonic combustor in accordance with one embodiment of this invention comprises a combustor front wall secured to at least one combustor side wall forming a hollow body open at one end. The combustor side walls are sealingly secured to the wall of a firetube boiler such that the open end of the hollow body is in communication with the end of a firetube within the boiler. The combustor front wall, together with the combustor side wall and the firetube wall form a cyclonic combustion chamber. In a preferred embodiment of the apparatus of this invention, each combustor side wall has water-cooling conduits for accommodating water flow through at least a portion thereof.

In accordance with another embodiment of this invention, a primary combustion zone discharge orifice is secured to a combustor side wall, between the primary combustion zone and the secondary combustion zone, separating the cyclonic combustion chamber into a primary combustion chamber and a secondary combustion chamber. A secondary combustion zone discharge orifice is secured to the firetube wall at or near a discharge end of the secondary combustion chamber.

In accordance with another embodiment of this invention, a primary combustion zone discharge orifice is secured to a plenum chamber wall, preferably a cylindrical wall, disposed within the cyclonic combustion chamber approximately parallel to the combustor side wall and firetube wall and forming an annular-shaped secondary air plenum for receiving secondary combustion air.

A primary nozzle is used to inject fuel and primary combustion air tangentially into the primary combustion zone. The primary nozzle is secured to the combustion chamber side wall and is in communication with the primary combustion zone.

In accordance with one embodiment of this invention, a secondary combustion air nozzle or secondary combustion air inlet pipe is used to introduce secondary combustion air into an annular-shaped secondary air plenum positioned downstream of the primary combustion zone discharge orifice and formed by a plenum chamber wall approximately parallel to the combustor side wall. Disposed within the plenum between the plenum chamber wall and the combustor side wall are swirl means such as a helical wall forming a helical channel and/or guide vanes through which secondary combustion air flows into the secondary combustion zone. The swirl means provide swirl to the secondary combustion air as it enters the secondary combustion zone.

In accordance with a preferred embodiment of this invention, a secondary combustion air inlet pipe is used to introduce secondary combustion air into an annular-shaped secondary air plenum positioned in the primary combustion zone and formed by a plenum chamber wall, preferably a cylindrical insert, disposed approximately parallel to the combustor side wall. Disposed within the plenum between the plenum chamber wall and the combustor side wall are swirl means through which secondary combustion air flows into the secondary combustion zone.

In accordance with another embodiment of this invention, a secondary combustion air nozzle is used to inject secondary combustion air tangentially into the secondary combustion zone. The secondary combustion air nozzle is secured to the combustor side wall and is in communication with the secondary combustion zone.

In accordance with one preferred embodiment of this invention, a natural water circulating system that utilizes gravity feed and the pressures generated within the water-steam mixture is used to circulate boiler water.

In accordance with another embodiment of this invention, a recirculation partition is disposed within the secondary combustion chamber forming a recirculation annulus between the partition and the plenum chamber wall for forced recirculation of combustion products from the primary combustion chamber in a upstream end of the secondary combustion chamber forming a reducing zone in the upstream end of the secondary combustion chamber and cooling the combustion products from the primary combustion chamber.

BRIEF DESCRIPTION OF THE DRAWINGS

The above and further objects and advantages of this invention will be apparent from the detailed description of further embodiments and by reference to the drawing wherein.

DESCRIPTION OF PREFERRED EMBODIMENTS

Figure 1:
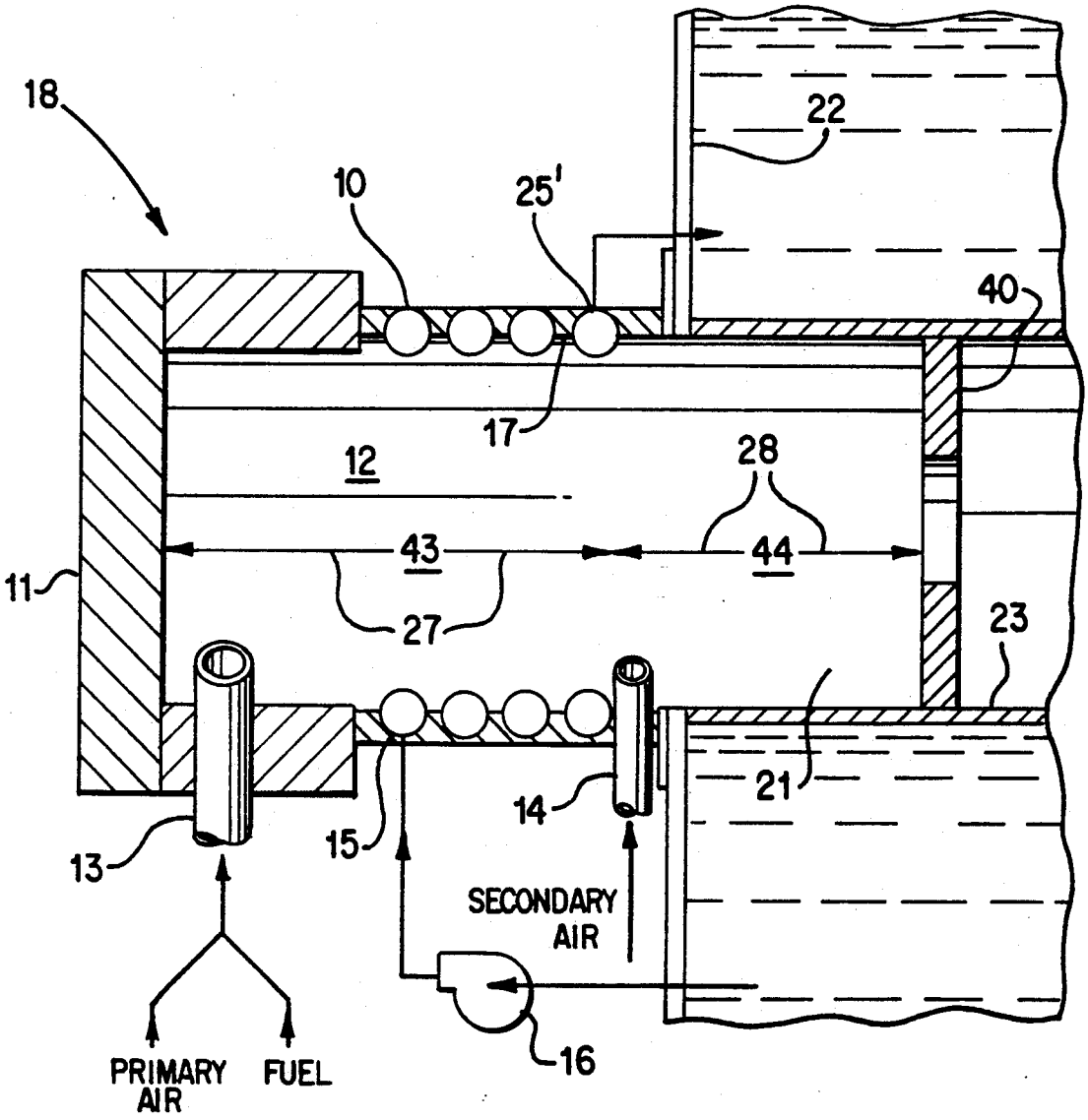
FIG. 1 is a cross-sectional side view of a water-cooled cyclonic burner, according to one embodiment of this invention.
Figure 2:
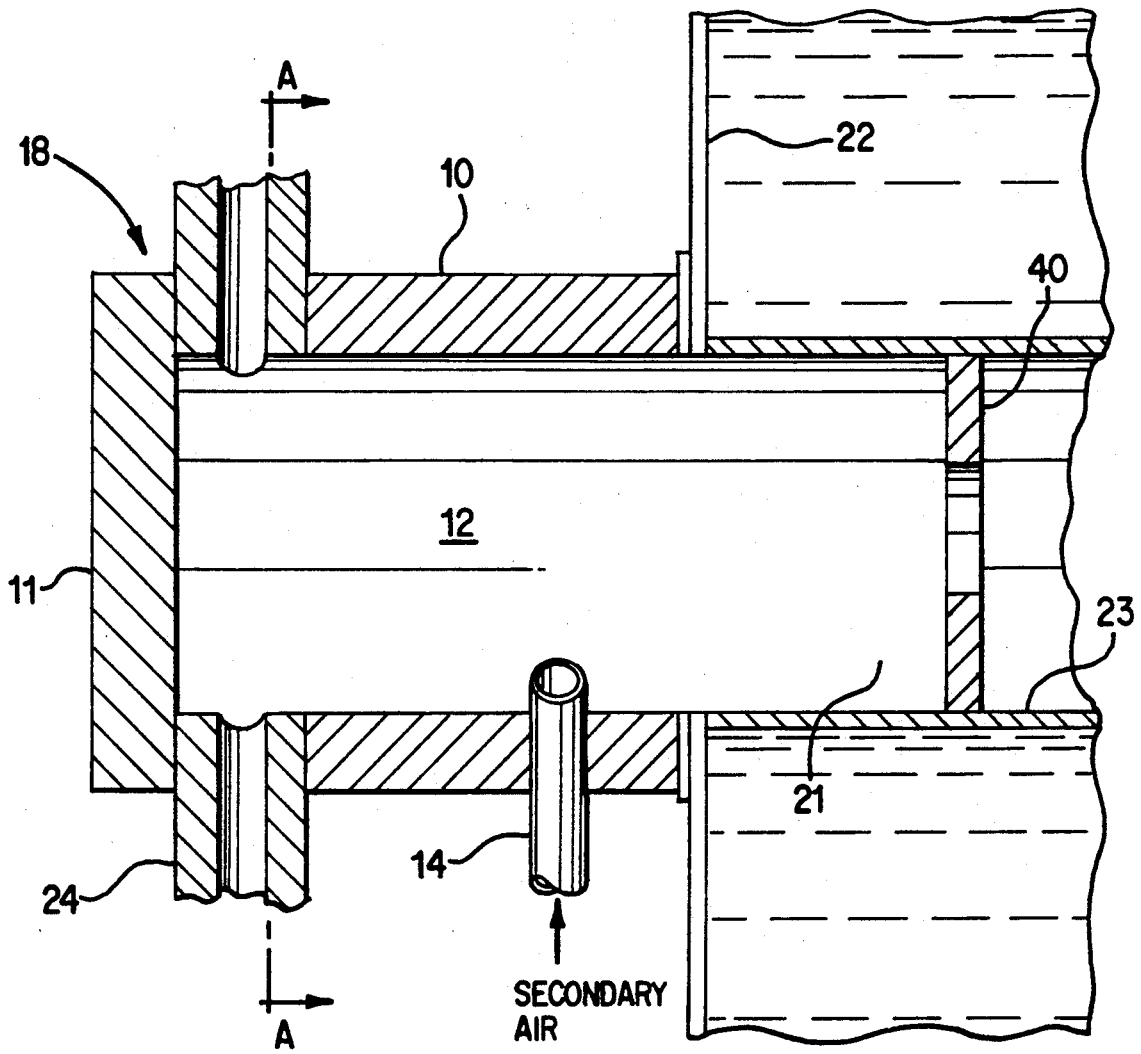
FIG. 2 is a cross-sectional side view of another embodiment of this invention in which tangential combustors are used to for combustion of fuel and primary combustion air prior to injection into a primary combustion zone.

Cyclonic burner 18, according to this invention, is designed to produce ultra-low pollutant emissions utilizing two-stage combustion of fossil fuel, the process of this invention, wherein the combustion air required for complete combustion of the fossil fuel, preferably natural gas, is introduced into combustion chamber 12 in stages. Approximately 30% to 90% of the stoichiometric requirement of combustion air, that is, primary combustion air, is introduced into the cyclonic first stage producing reducing primary combustion zone 43. Approximately 10% to 90% of the stoichiometric requirement of combustion air, that is, secondary combustion air, is introduced into the cyclonic second stage producing oxidizing secondary combustion zone 4. To control temperature within the combustion chamber, preferably between about 1600° F. and 2400° F., a cooling fluid, preferably water, is circulated around combustion chamber 12 to remove heat from within the combustion chamber.

In a preferred embodiment of this invention, the primary combustion air is premixed with the fossil fuel producing a primary combustion air/fuel mixture, which mixture is injected tangentially into the cyclonic combustion chamber into reducing primary combustion zone 43. Secondary combustion air is injected tangentially into oxidizing secondary combustion zone 44 for complete combustion of the fuel with high intensity, low excess air, preferably below about 5% and resulting in ultra-low pollutant emissions, with $NO_x$ less than or equal to 20 vppm, carbon monoxide (CO) less than or equal to 50 vppm and total hydrocarbons (THC) equal less than or equal to 10 vppm.

Figure 6:
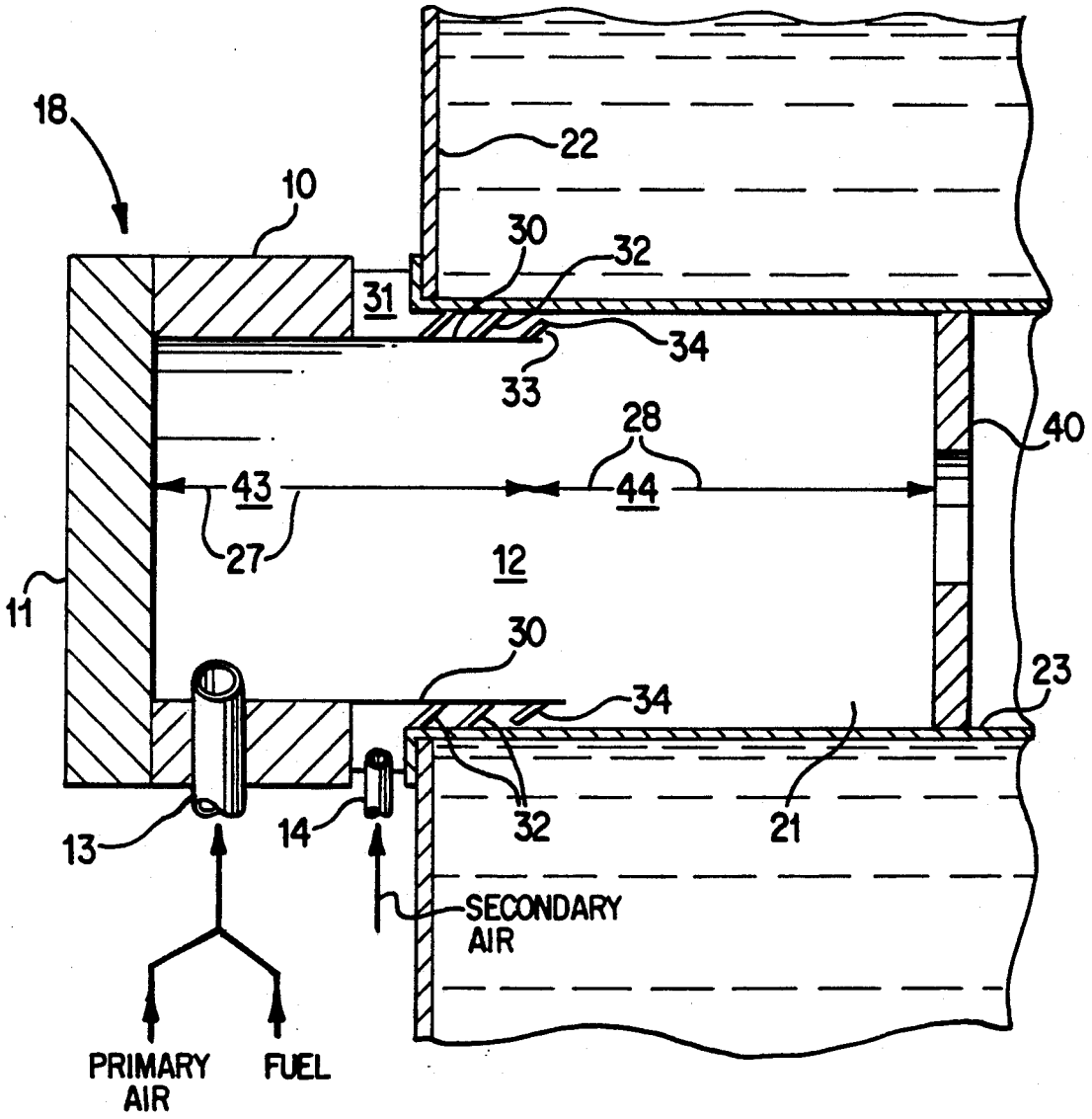
FIG. 6 is a cross-sectional side view of another embodiment of this invention in which secondary combustion air is introduced into the secondary combustion zone through an annular-shaped plenum.
Figure 7:
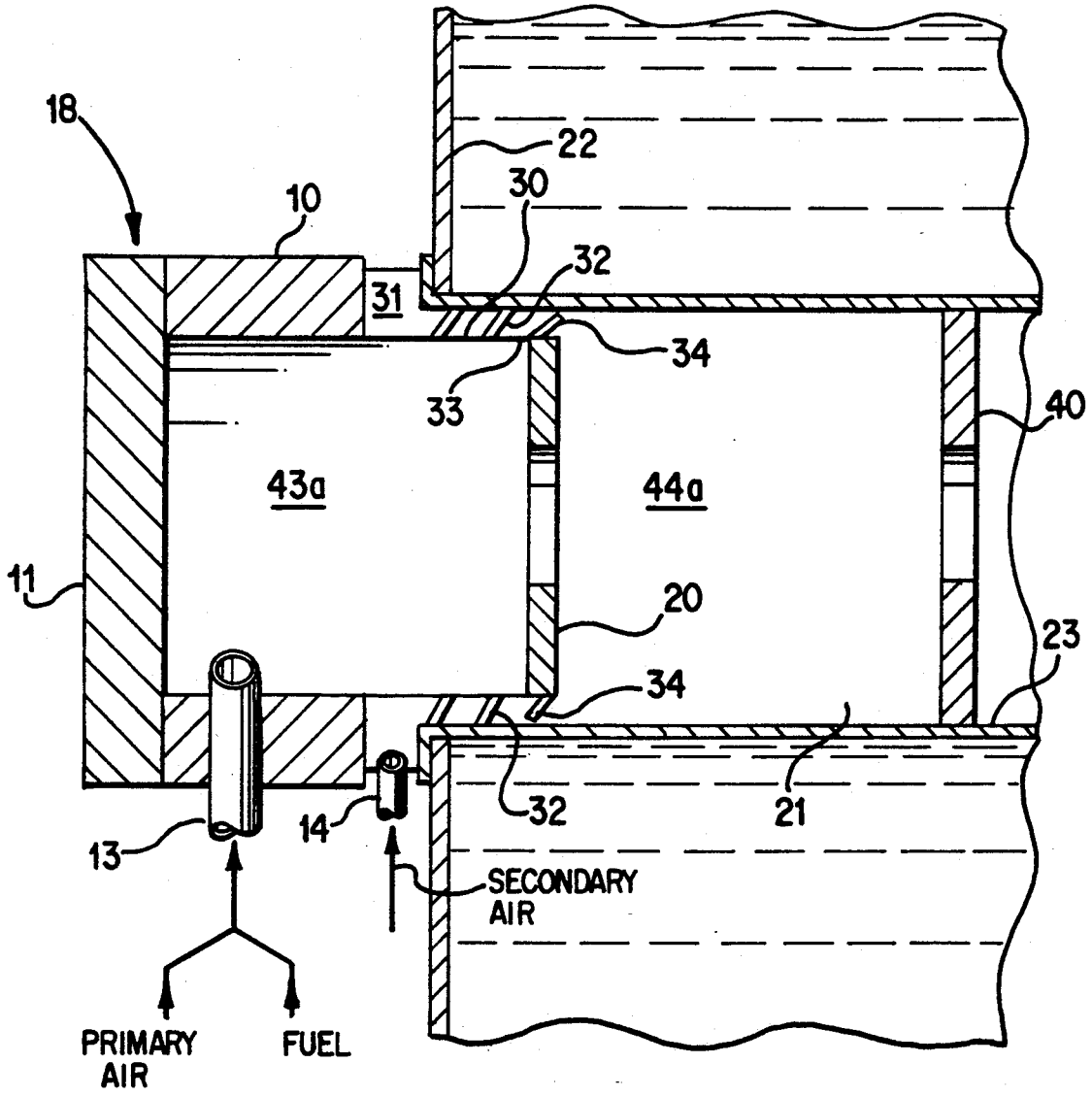
FIG. 7 is a cross-sectional side view of another embodiment of this invention in which a primary combustion zone discharge orifice is positioned near the discharge end of the annular-shaped plenum.

In a preferred embodiment of this invention, secondary combustion air is introduced into a plenum 31 as shown in FIG. 6 and then introduced into oxidizing secondary combustion zone 44 in a manner which imparts a swirling flow to the secondary combustion air.

In all embodiments of this invention, at least one of combustor side walls 10 is secured to combustion chamber front wall 11. It is apparent that combustor side walls 10 can comprise either one generally cylindrical wall or multiple walls which are arranged to form cyclonic combustion chamber 12. Regardless of how combustor side walls 10 are arranged, it is important that the overall structure accommodate swirling flow through primary combustion zone 43, designated generally by arrows 27, and secondary combustion zone 44, designated generally by arrows 28.

Water cooling provides a means for controlling the temperatures within primary combustion zone 43 and secondary combustion zone 44. To control the formation of $NO_x$, it is preferred to maintain the temperatures within the primary combustion zone and the secondary combustion zone between about 1600° F. and 2400° F. Accordingly, in the embodiment of this invention shown in FIG. 1, at least one combustor side wall 10 has water-cooling means for accommodating water flow through at least a portion of each combustor side wall 10. In a preferred embodiment according to this invention, the water-cooling means comprises evaporative cooling coil 15. It is apparent that evaporative cooling coil 15 can comprise one cooling coil or multiple cooling coils. It is also apparent that evaporative cooling coil 15 can be sized to produce Various heat transfer rates. The heat transfer rate required, which in turn will determine the size and disposition of evaporative cooling coil 15 in cyclonic combustion chamber 12, is a function of the size of cyclonic combustion chamber 12 and the amount of fuel burned therein. Evaporative cooling coil 15 is preferably either secured to or adjacent inside surface 17 of combustor side wall 10. However, evaporative cooling coil 15 can also be positioned Within combustor side wall 10. An inlet to evaporative cooling coil 15 is preferably in communication with Water circulation pump 16. Discharge nozzle 25 of evaporative cooling coil 15 is preferably in communication with the boiler of which boiler wall 22 is shown. A water/steam mixture produced in the water-cooled walls at a pressure somewhat higher than the boiler steam pressure is injected through discharge nozzle 25 into the boiler upper section below the boiler water level.

Water cooling is also achieved through the wall of firetube 23. It is preferred that at least a portion of secondary combustion zone 44 is disposed in the front end of boiler firetube 23. A portion of the heat generated by the combustion process in cyclonic burner 18 is removed through the wall of firetube 23 by water surrounding firetube 23 disposed in the boiler. By maintaining low temperatures within cyclonic burner 18, $NO_x$ formation is maintained below about 20 vppm. In addition, firetube 23 also absorbs heat from plenum chamber wall 30 and helical wall 32, FIG. 6, thereby prolonging their serviceable life.

In those embodiments of this invention which include primary combustion zone discharge orifice 20, it is secured to combustor side wall 10 and positioned between primary combustion zone 43 and secondary combustion zone 44, forming primary combustion chamber **43*a* and secondary combustion chamber 44*a* within cyclonic burner 18. Secondary combustion zone discharge orifice 40 is preferably secured to the wall of firetube 23 and positioned at or near discharge end 21 of secondary combustion zone 44. Primary combustion zone discharge orifice 20 may comprise a plate structure, a refractory wall or another suitable structure for passing combustion products from primary combustion zone 43 to secondary combustion zone 44**.

Primary tangential injection means are secured to combustor side wall 10 and in communication With primary combustion zone 43. According to a preferred embodiment of this invention, primary tangential injection means comprise at least on primary nozzle 13 secured to combustor side wall 10 and in communication with primary combustion zone 43. Each primary nozzle 13 is preferably positioned adjacent inside surface 17 Of combustor side wall 10 and off-center with respect to a centerline axis of primary combustion zone 43 on combustor side wall 10.

Figure 3:
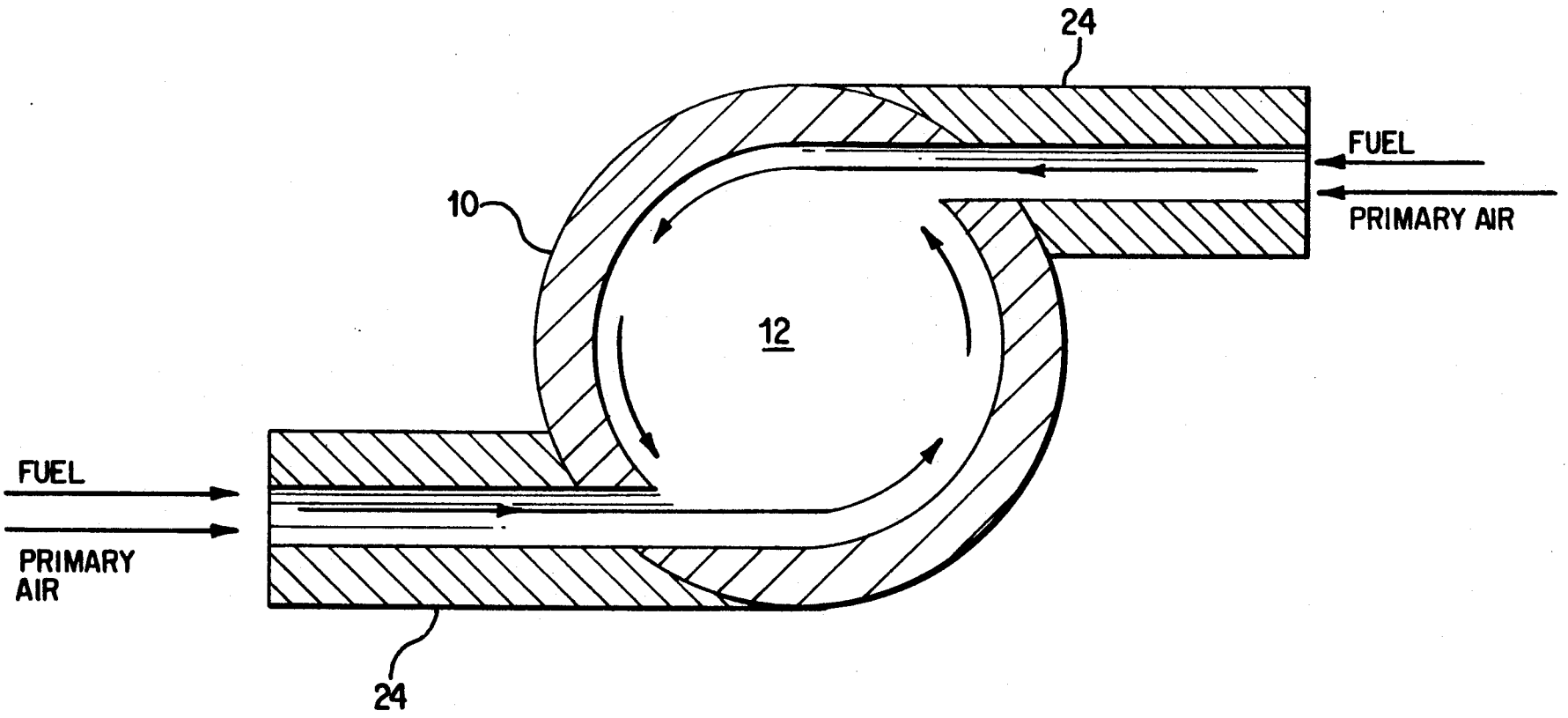
FIG. 3 is a view of the embodiment shown in FIG. 2 along section A—A.
Figure 4:
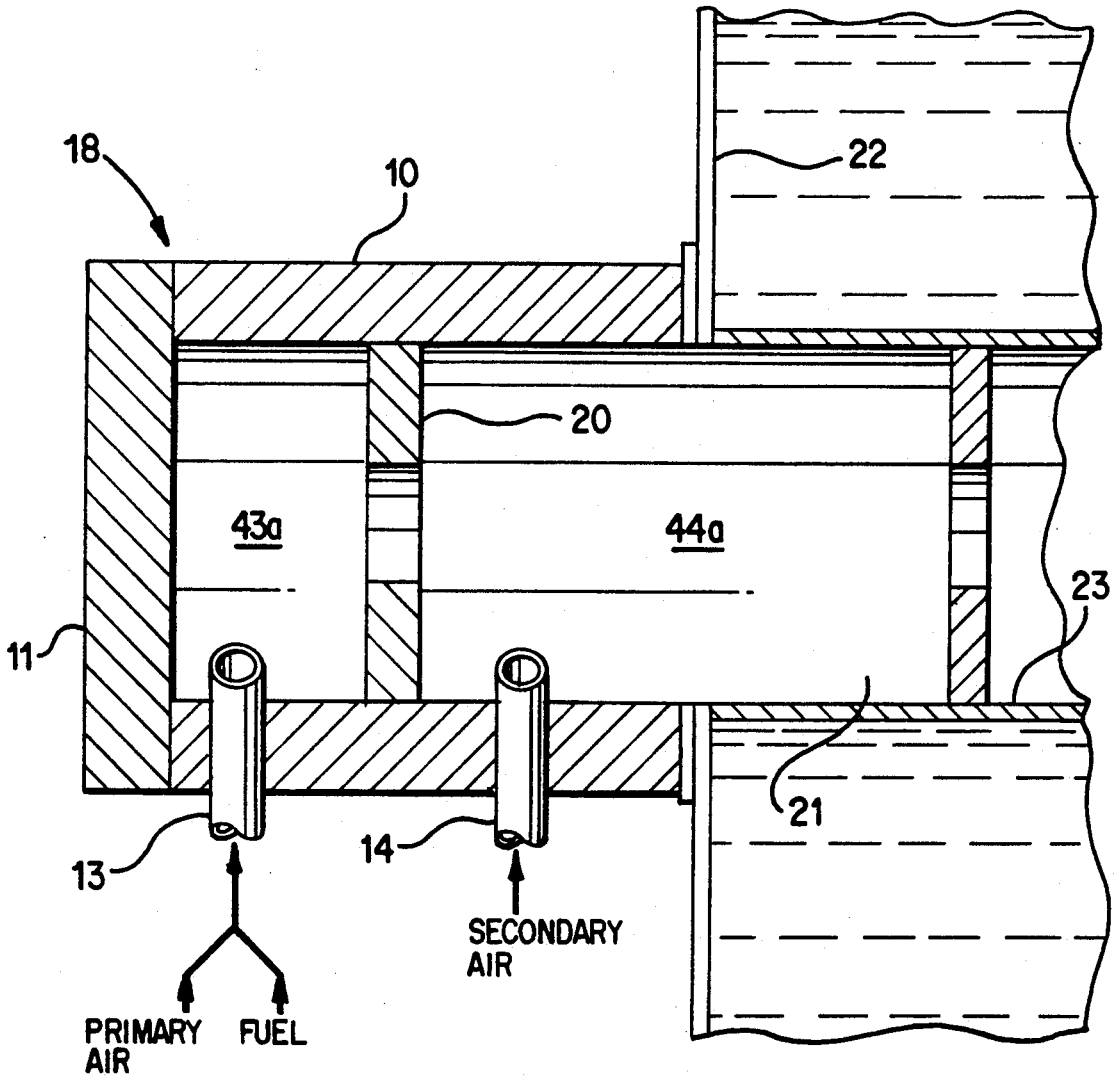
FIG. 4 is a cross-sectional side view of another embodiment of this invention in which the primary and secondary combustion zones are separated by an orifice.

In accordance with another preferred embodiment, primary tangential injection means comprise at least one tangential combustor 24 secured to combustor side wall 10 and in communication with primary combustion zone 43. As with primary nozzle 13, tangential combustor 24 is preferably positioned adjacent inside surface 17 of combustor side wall 10 and off-center with respect to a centerline axis of primary combustion zone 43 on combustor side wall 10 as shown in FIG. 3.

Secondary combustion air injection means are used to inject secondary combustion air tangentially or with a swirl into secondary combustion zone 44. In one preferred embodiment according to this invention, secondary combustion air injection means comprises at least one secondary combustion air nozzle 14 having a similar arrangement to primary nozzle 13, only in communication with secondary combustion zone 44. Each secondary combustion air nozzle 14 is preferably positioned adjacent downstream of primary combustion zone 43, and off-center with respect to a centerline axis of secondary combustion zone 44 on combustor side wall 10.

In accordance with another embodiment of this invention, secondary combustion air injection means comprise plenum chamber wall 30, preferably a cylindrical insert, disposed inside combustion chamber 12 in primary combustion zone 43 or secondary combustion zone 44 and approximately parallel to combustor side wall 10, forming annular-shaped plenum 31 between the wall of firetube 23 and plenum chamber wall 30. Secondary combustion air nozzle 14 is secured to combustor side wall 10 and in communication with annular-shaped plenum 31. Annular-shaped plenum 31 has plenum discharge end 33 facing combustion chamber discharge end 21. Positioned within annular-shaped plenum 31 is helical wall 32 forming a helical channel. Also positioned within annular-shaped plenum 31 near plenum discharge end 33 is guide vane 34. Secondary combustion air introduced into annular-shaped plenum 31 through secondary combustion air nozzle 14 flows through plenum discharge end 33 into secondary combustion zone 44. Helical wall 32 and guide vane 34 impart a swirling flow to the secondary combustion air as it passes through plenum discharge end 33 into secondary combustion zone 44 causing cyclonic flow within secondary combustion zone 44. It is apparent that either primary tangential injection means and/or secondary combustion air injection means may comprise other suitable components for swirling the medium in the appropriate combustion zone.

Figure 5:
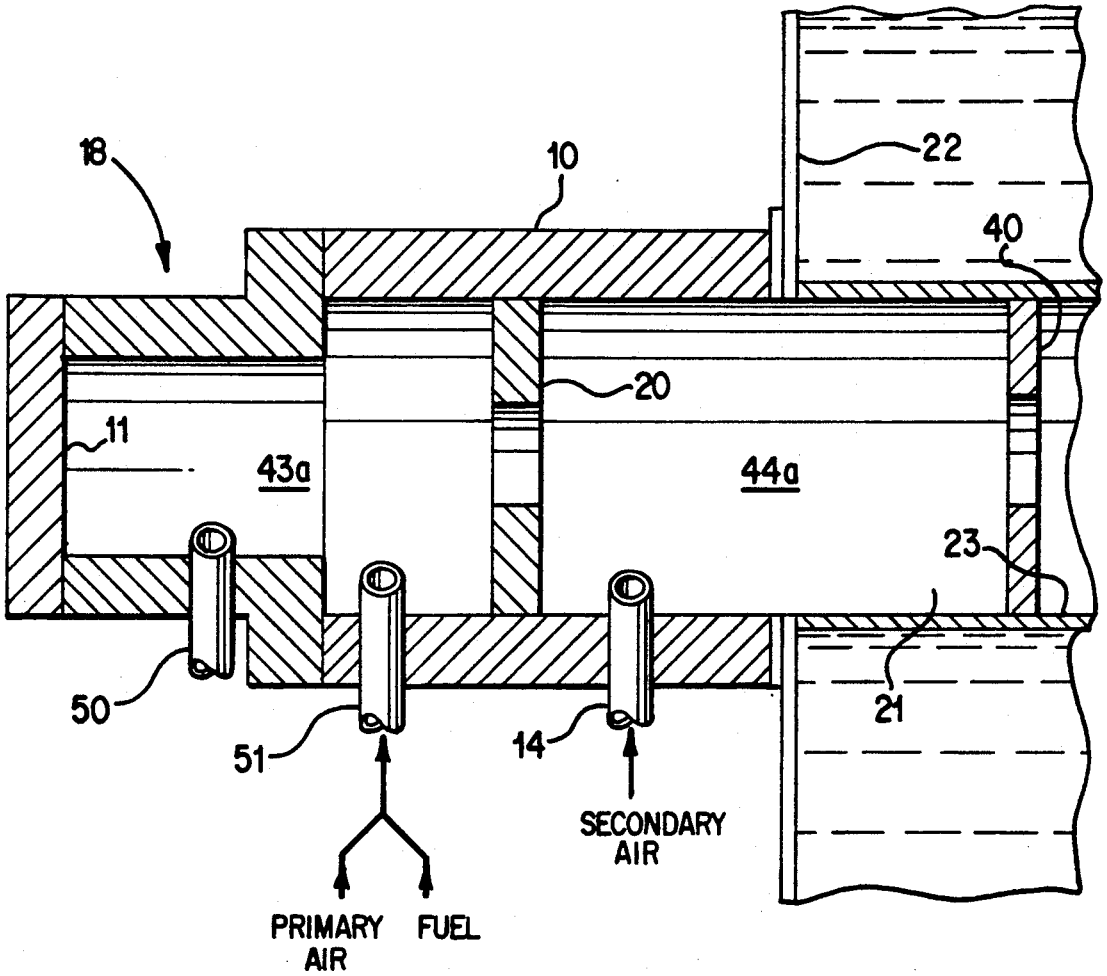
FIG. 5 is a cross-sectional side view of another embodiment of this invention in which fuel and primary air can be modulated between a low fuel input and a high fuel input.

FIG. 5 shows another embodiment of this invention in which primary tangential injection means comprises turndown nozzle 50 and full capacity nozzle 51 for providing a low-fire operating mode and a high-fire operating mode of cyclonic burner 18. In addition, primary combustion chamber **43*a* comprises a narrower first portion into which fuel and primary combustion air are injected through turndown nozzle 50 when cyclonic burner 18 is operated in a low-fire, or turndown, operating mode and a wider second portion into which fuel and primary combustion air are injected through full capacity nozzle 51 when cyclonic burner 18** is operated in a high-fire, or full capacity, operating mode.

Figure 8:
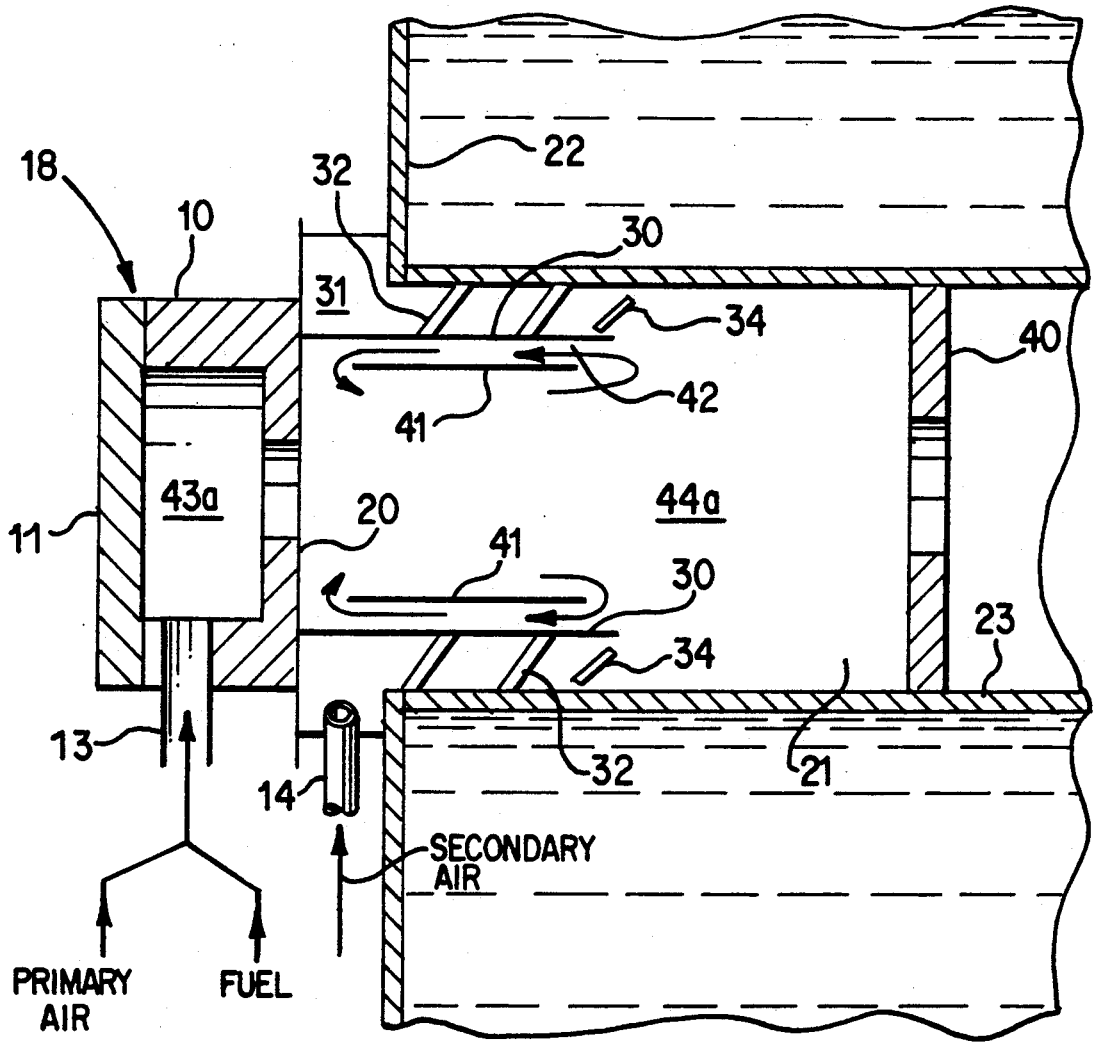
FIG. 8 is a cross-sectional side view of another embodiment of this invention in which combustion products are recirculated by a recirculation partition.

In accordance with the embodiment of this invention shown in FIG. 8, recirculation partition 41 is disposed within an upstream portion of secondary combustion chamber 44a, parallel to plenum chamber wall 30, forming recirculation annulus 42. Combustion products, comprising CO and $H_2$ species, from primary combustion chamber 43a passing through primary combustion zone discharge orifice 20 at high velocity into secondary combustion chamber 44a create a negative pressure in the upstream portion of secondary combustion chamber 44a near the side of primary combustion zone discharge orifice 20 facing secondary combustion chamber 44a. This causes a portion of the combustion products from primary combustion chamber 43a entering the downstream portion of secondary combustion chamber 44a to be drawn back, or recirculated, as shown by arrows, through recirculation annulus 42 thereby mixing with and cooling combustion products entering the upstream portion of secondary combustion chamber 44a through primary combustion zone discharge orifice 20. The upstream portion of secondary combustion chamber 44a in accordance with this embodiment of the invention is a reducing zone. Thus, cooled gases, containing active molecules recirculated to the exit of primary combustion zone discharge orifice 20, intensify partial combustion of the unburned fuel and reduce the temperature in this zone. At the same time, reducing conditions suppress thermal $NO_x$ formation in the primary combustion zone, thereby reducing the formation of $NO_x$ in cyclonic burner 18.

Secondary combustion air from plenum 31 is injected into secondary combustion zone 44 where complete combustion of the fuel with high intensity, low excess air, preferably below about 5%, and low pollutant emissions occurs. Because partially combusted gases from primary combustion zone 43 contain mostly CO and $H_2$ species, second stage combustion can be efficiently accomplished with very low excess air in a small combustion chamber. Low excess air and the absence of high peak temperatures in secondary combustion zone 44 minimizes $NO_x$ formation.

Figure 9:
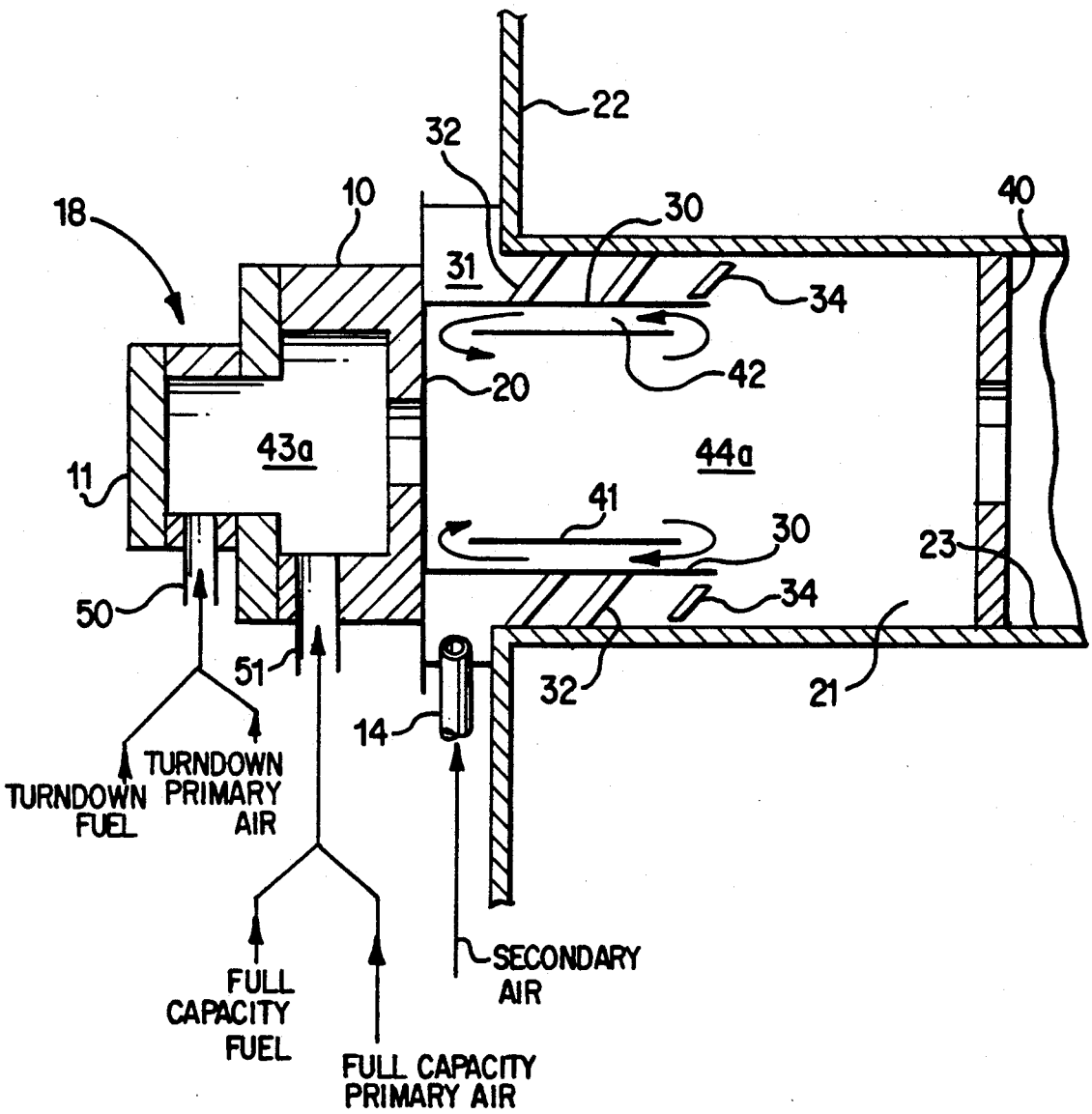
FIG. 9 is a cross-sectional side view of another embodiment of this invention in which fuel and primary air can be modulated between a low fuel input and a high fuel input and combustion products are recirculated.

In the embodiment shown in FIG. 9, primary combustion chamber 43a is shown having a narrower portion and a wider portion to provide for turndown and full capacity operating modes.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

I claim:

1. A process for cyclonic combustion with ultra-low pollutant emissions and high efficiency in firetube boilers, comprising the steps of:

(a) tangentially injecting fuel into a primary combustion zone of a combustion chamber of a cyclonic burner;

(b) tangentially injecting primary combustion air into the primary combustion zone in an amount equal to between about 30% and about 90% of a stoichiometric requirement for complete combustion of the fuel;

(c) burning a primary combustion air/fuel mixture formed by the fuel and the primary combustion air, within the primary combustion zone, forming primary combustion products;

(d) injecting secondary combustion air into a secondary combustion zone of the combustion chamber of the cyclonic burner in an amount equal to between about 10% and about 90% of the stoichiometric requirement;

(e) completing combustion in the secondary combustion zone, forming products of complete combustion; and (f) water-cooling at least a portion of a combustor side wall and a firetube wall which define the primary combustion zone and the secondary combustion zone.

2. A process according to claim 1 further comprising premixing the fuel and the primary combustion air prior to injection into the primary combustion zone.

3. A process according to claim 1 further comprising passing the primary combustion products through a primary combustion zone discharge orifice positioned within the combustion chamber.

4. A process according to claim 3, wherein the primary combustion products exiting the primary combustion zone discharge orifice are mixed with the secondary combustion air.

5. A process according to claim 3, wherein the primary combustion products exiting the primary combustion zone discharge orifice are recirculated in an upstream end of said secondary combustion zone forming a reducing zone in said upstream end of said secondary combustion zone and cooling said primary combustion products entering said reducing zone.

6. A process according to claim 1, wherein said secondary combustion air is one of tangentially injected and injected in a manner which imparts a swirl to said secondary combustion air.

7. A process according to claim 1 further comprising discharging the products of complete combustion through a secondary combustion zone discharge orifice positioned within said combustion chamber at a discharge end of said combustion chamber.

8. A process according to claim 1, wherein the secondary combustion air is injected into the secondary combustion zone at an exterior location with respect to a vessel wall to which the cyclonic burner is secured.

9. A process according to claim 1, wherein a temperature within the combustion chamber is maintained between about 1600° F. and about 2400° F.

10. A cyclonic burner for firetube boilers and heaters comprising:

at least one combustor side wall secured to a combustor front wall defining a hollow body having an open end;

a firetube linearly in communication with said open end of said hollow body, said combustor side wall, said combustor front wall and said firetube defining a combustion chamber having a primary combustion zone and a secondary combustion zone;

cooling means for cooling said primary combustion zone surrounding a portion of said primary combustion zone and for cooling said secondary combustion zone surrounding a portion of said secondary combustion zone;

primary tangential injection means for tangentially injecting a fuel and primary combustion air into said primary combustion zone disposed toward said combustion chamber front wall;

secondary combustion air injection means for injecting secondary combustion air with a swirl into said secondary combustion zone;

a secondary combustion zone discharge orifice secured to a firetube wall of said firetube and positioned at a combustion chamber discharge end;

a vessel wall, each said combustor side wall secured to said vessel wall; and said firetube secured to said vessel wall.

11. A cyclonic burner for firetube boilers and heaters in accordance with claim 10, wherein said secondary combustion air injection means comprises at least one plenum chamber wall coaxially disposed within said combustion chamber defining an annular-shaped secondary combustion air plenum between at least one of said firetube wall and each said combustor side wall and said plenum chamber wall.

12. A cyclonic burner for firetube boilers and heaters in accordance with claim 11, wherein said secondary combustion air injection means further comprises at least one of a helical wall secured to said plenum chamber wall forming a helical channel and a plurality of guide vanes secured to said plenum chamber wall and positioned at a plenum discharge end.

13. A cyclonic burner for firetube boilers and heaters in accordance with claim 11, wherein said secondary combustion air injection means further comprises plenum injection means for injecting said secondary combustion air into said secondary combustion air plenum.

14. A cyclonic burner for firetube boilers and heaters in accordance with claim 13, wherein said plenum injection means further comprises at least one of a secondary combustion air nozzle and a secondary combustion air inlet pipe.

15. A cyclonic burner for firetube boilers and heaters in accordance with claim 14, wherein a primary combustion zone discharge orifice is secured to one of each said combustor side wall and said plenum chamber wall and positioned between said primary combustion zone and said secondary combustion zone, forming a primary combustion chamber and a secondary combustion chamber within said combustion chamber.

16. A cyclonic burner for firetube boilers and heaters in accordance with claim 15, wherein at least one recirculation partition is coaxially disposed within an upstream end of said secondary combustion chamber, forming a recirculation annulus between said plenum chamber wall and said recirculation partition through which combustion products existing through said primary combustion zone discharge orifice from said primary combustion chamber are recirculated within said upstream end of said secondary combustion chamber.

17. A cyclonic burner for firetube boilers and heaters in accordance with claim 16, wherein said primary combustion chamber has an upstream diameter which is smaller than a downstream diameter.

18. A cyclonic burner for firetube boilers and heaters in accordance with claim 17, wherein said primary tangential injection means comprises a turndown nozzle secured to said combustor side wall proximate said combustor front wall and in communication with a first portion of said primary combustion chamber having said upstream diameter, and a full capacity nozzle secured to said combustor side wall proximate said primary combustion zone discharge orifice and in communication with a second portion of said primary combustion chamber having said downstream diameter.

19. A cyclonic burner for firetube boilers and heaters in accordance with claim 18, wherein said cooling means comprises at least one of an evaporative cooling coil and said firetube and circulation means for circulating a cooling fluid.

20. A cyclonic burner for firetube boilers and heaters in accordance with claim 19, wherein said primary tangential injection means comprises at least primary nozzle secured to said combustor side wall in communication with said primary combustion zone.

21. A cyclonic burner for firetube boilers and heaters in accordance with claim 20, wherein each said primary nozzle is positioned adjacent an inside surface of said combustor front wall and off-center, on said combustor side wall, with respect to a centerline axis of said primary combustion zone.

22. A cyclonic burner for firetube boilers and heaters in accordance with claim 10, wherein said secondary combustion air injection means further comprises at least one secondary combustion air nozzle secured to said combustor side wall and in communication with said secondary combustion zone.

23. A cyclonic burner for firetube boilers in accordance with claim 22, wherein each said secondary combustion air nozzle is positioned downstream of said primary combustion zone and off-center, on said combustor side wall, with respect to a centerline axis of said secondary combustion zone.

* * * * *